US010393083B2

(12) United States Patent
Boulais et al.

(10) Patent No.: US 10,393,083 B2
(45) Date of Patent: Aug. 27, 2019

(54) SYSTEM FOR REMOTE STARTING OF VEHICLE WITH MANUAL TRANSMISSION

(71) Applicant: AUTOMOTIVE DATA SOLUTIONS, INC., Montreal (CA)

(72) Inventors: Sebastien Boulais, McMasterville (CA); Simon Pilikian, Montreal (CA)

(73) Assignee: Automotive Data Solutions, Inc., Montreal (CA)

( * ) Notice: Subject to any disclaimer, the term of this patent is extended or adjusted under 35 U.S.C. 154(b) by 0 days.

(21) Appl. No.: 15/989,043

(22) Filed: May 24, 2018

(65) Prior Publication Data

US 2018/0340502 A1 Nov. 29, 2018

Related U.S. Application Data

(60) Provisional application No. 62/510,959, filed on May 25, 2017.

(51) Int. Cl.
*F02N 11/08* (2006.01)
*F02N 11/10* (2006.01)

(52) U.S. Cl.
CPC ..... *F02N 11/0807* (2013.01); *F02N 11/103* (2013.01); *F02N 11/101* (2013.01); *F02N 2200/061* (2013.01); *F02N 2200/0801* (2013.01); *F02N 2200/0802* (2013.01); *F02N 2200/0803* (2013.01); *F02N 2200/0814* (2013.01); *F02N 2200/0815* (2013.01); *F02N 2200/102* (2013.01)

(58) Field of Classification Search
CPC .... F02N 11/08; F02N 11/0807; F02N 11/101; F02N 2200/061; F02N 2200/0801; F02N 2200/0802; F02N 2200/0803; F02N 2200/0814; F02N 2200/0815; F02N 2200/102
See application file for complete search history.

(56) References Cited

U.S. PATENT DOCUMENTS

| | | | | |
|---|---|---|---|---|
| 2,647,178 | A * | 7/1953 | Handy | B60K 23/00 200/61.54 |
| 4,345,554 | A | 8/1982 | Hildreth et al. | |
| 5,024,186 | A | 6/1991 | Long et al. | |
| 5,646,457 | A | 7/1997 | Vakavtchiev | |
| 7,532,959 | B2 | 5/2009 | Ochs et al. | |
| 8,615,334 | B2 * | 12/2013 | Ewert | B60T 7/02 701/2 |
| 2005/0216148 | A1 | 9/2005 | Min et al. | |
| 2014/0149025 | A1 | 5/2014 | Fazi | |
| 2014/0256509 | A1 | 9/2014 | Cousins et al. | |

FOREIGN PATENT DOCUMENTS

| | | | |
|---|---|---|---|
| CA | 2366930 | A1 | 7/2002 |
| CA | 2660210 | A1 | 10/2009 |
| CA | 2785102 | A1 | 7/2011 |

* cited by examiner

*Primary Examiner* — Hieu T Vo
(74) *Attorney, Agent, or Firm* — Trojan Law Offices

(57) ABSTRACT

A remote vehicle starter system for vehicles with manual transmission with improved safeguards for preventing the vehicles from being remotely started while the manual transmission is in gear. The remote vehicle starter system for vehicles with manual transmission may also include additional safeguards to prevent the vehicles from being remotely started when there is a risk that the vehicle may move upon being remotely started, such as when the door has been opened after the vehicle has been placed in state safe for remote start.

8 Claims, 6 Drawing Sheets

SYSTEM FOR REMOTE STARTING OF VEHICLE WITH MANUAL TRANSMISSION

STATEMENT OF PRIORITY

This application claims priority to U.S. Provisional Application No. 62/510959, filed May 25, 2017.

TECHNICAL FIELD

The present disclosure relates to a system and method for starting vehicles remotely, and more particularly, remote starters for vehicles with manual transmission having an improved safety routine.

BACKGROUND OF THE INVENTION

A remote starter is a device that allows a user to start a vehicle's engine by remote control. It is essentially comprised of a transmitter, usually attached to a key fob, which communicates with a receiver associated with the ignition mechanism of the vehicle. When the transmitter is activated, it sends a signal to the receiver to automatically start the vehicle at a distance without the driver having to be inside the vehicle and insert a key in the ignition to start the engine.

Remote starters are useful because they allow vehicles to be pre-warmed in cold weather and pre-cooled in hot weather. In cold weather, a remote starter allows a driver to start a car remotely to warm up the engine and activate the heater and defroster without having to trudge through snow or wait outside in freezing temperatures. In hot weather, a remote starter allows the driver to start up the air conditioning before getting inside a hot car.

Remote starters, however, are generally designed for cars having automatic transmission, not for cars having manual transmission. This is because for a manual transmission car, one key safety concern is that if the car is left in gear, then it will move when it is started remotely, which could cause personal injury or property damage. Hence, vehicle manufacturers generally produce remote engine starters for automatic transmission vehicles only. For manual transmission vehicles, remote engine starters are available as an aftermarket accessory.

In order to prevent the risk of remotely starting a car while it is in gear, it is necessary to put the transmission in neutral so that the vehicle does not accidentally lurch when the engine is activated. To make sure that the transmission is in neutral, remote starters for manual transmission vehicles require the driver to implement a safety routine before a remote starter can be used to turn on the engine. As described more fully below, this safety routine is known as a "Reservation Mode," which comprises a set of safety protocols that have to be set at the end of a particular driving operation to enable a remote start of the vehicle the next time the vehicle is to be used.

All aftermarket remote starters generally use the same Reservation Mode procedures for remote starting manual transmission vehicles. For example, to be able to remote start a vehicle, the user has to put the vehicle into the Reservation Mode according to the following steps: 1) Start the vehicle using the key; 2) Set gear to neutral by depressing the clutch pedal and moving the gear shift to the neutral position where it can be moved from side to side; 3) Press the brake pedal; 4) Pull the handbrake; 5) Release the brake pedal; 6) Activate the remote starter system; 7) Remove the key from the ignition while leaving the engine running; 8) Open the door and exit the vehicle; 9) Close all doors; and 10) Stop the engine using the transmitter of the remote starter system, whereupon the engine will shutdown and the vehicle is put into the Reservation Mode.

After the vehicle has been put into the Reservation Mode, the vehicle is considered to be in neutral gear and in a safe condition to be remote started. The vehicle can then be remote started using the transmitter the next time the user wants to use the vehicle.

When the user attempts to use the remote starter system to remote start a vehicle after the user had successfully placed the vehicle in the Reservation Mode, the remote starter system will NOT allow the vehicle to be remote started if any of the following conditions have occurred since the vehicle was placed into Reservation Mode: 1) Door was opened; 2) Hood was opened; 3) Brake pedal was pressed; 4) Handbrake was released; or 5) Ignition has been placed on the "ON" position.

Despite the safety feature described above, the Reservation Mode for existing remote starters is inadequate to ensure that a manual transmission vehicle can be safely turned on by remote because such systems do not take into account situations where the vehicle is inadvertently (or not inadvertently) put into gear after the Reservation Mode is set. For example, a child could gain access into the car and accidentally put the shifter into gear. Even if the car doors were locked, it would still be possible for someone to access the car's interior through a sunroof, through an open window, or a trunk opening to put the shifter into gear. In other words, even when the shift is properly set in neutral during the Reservation Mode, there is no way to tell if the shift is subsequently changed after the Reservation Mode is set. In any of these scenarios, if the vehicle is remote started, it will move since it is in gear. As a consequence, the vehicle can be damaged, or the vehicle can damage property, and most importantly, the vehicle can cause injury to people.

Some aftermarket remote starters have an optional or mandatory accelerometer to detect vehicle movement during remote start. Once movement is detected, the remote starter will shutdown the engine. However, this does not prevent the vehicle from moving, which leaves the risk that remotely starting the vehicle may still cause personal injury or property damage.

Therefore, there exists a need for a remote starter system and method for vehicles with manual transmission with improved safeguards for preventing the vehicles from being remotely started while in gear.

SUMMARY OF THE INVENTION

In view of the foregoing, it is an object of the present invention to provide a remote starter system and method for vehicles with manual transmission with improved safety features that prevent vehicles with manual transmission from being remotely started while the vehicle is in gear.

According to an embodiment of the present invention, a system for remote starting of a vehicle with manual transmission may include a remote control having a wireless transmitter that can be activated with a key fob, or other device, to start the vehicle engine without having to insert a key into the ignition or otherwise enter the vehicle.

According to an embodiment of the present invention, the remote starter is configured to operate in vehicles with manual transmission mode, through such means as programming menu, loop to cut, jumpers, or other means. The remote starter system must be programmed to detect engine rotation (RPM) and the presence of a sensor mounted on the shifter. The remote starter system may be programmed to detect vehicle speed (MPH or KPH).

To enable a vehicle to be remote started, a user must place the vehicle into Reservation Mode, which may be accomplished using the following steps: 1) while the vehicle is running, pressing the brake pedal and setting the gear to neutral so that the sensor mounted on the gear shifter is not tied to the chassis; 2) setting the emergency brake by pulling the handbrake and releasing the brake pedal; 3) activating the remote starter; 4) removing the key from the vehicle ignition while leaving the engine running; 5) exiting the vehicle, closing and locking all the doors; and 6) Stopping the engine using the remote control for the remote starter. The engine will shut down and the vehicle has been placed into Reservation Mode. The remote starter system will make a checksum of all the variables in the memory required to make a remote start decision and send it to the sensor. The vehicle, in Reservation Mode and in neutral gear will be considered safe to be remote started.

The remote starter system may be configured to communicate with the vehicle's computer system (data bus) for determining a number of operational variables of the vehicle, such as engine rotation speed (RPM), vehicle speed (MPH, KPH), and to detect other conditions of the vehicle, such as the activation status of the vehicle's alarm system, whether the vehicles doors, hood, trunk, and windows are opened or closed, whether the brake is or is not pressed, the engagement of the handbrake, and whether the ignition is on the on state or off state.

The remote starter system may further include a control module that is configured to start the engine. The control module is a standard module known in the art for starting vehicles.

According to an embodiment of the present invention, the remote starter system may also include a digital sensor and an accelerometer mounted on the gear shifter of the manual transmission vehicle to determine the positioning of the gear shift. The sensor and accelerometer mounted on the gear shifter may be able to learn the neutral position at the initiation of every Reservation Mode. As described above, in an embodiment of the present invention, to place the vehicle in Reservation Mode, the user must move the gear shifter from left to right before placing the gear in neutral. The movement of the gear shifter from left to right signals to the remote starter system that the gear will be placed in neutral and the sensor may be capable of recording and storing information concerning changes in the position of the gear shift after the user has set the vehicle in neutral during Reservation Mode.

Thus, the vehicle's relative position to normal gravity of earth would not effect whether the sensor's ability to determine when the gear shifter has been moved from neutral. For example, the sensor and accelerometer can accurately determine that the vehicle is neutral even though the user may park the vehicle on a flat surface, or parked on an incline, such as uphill or downhill because the sensor and accelerometer learns the positon of the gear shifter in neutral at every Reservation Mode initiation procedure.

If the sensor detects that the transmission is in neutral, it will enable the remote starter system to remote start the engine of the vehicle. If, on the other hand, the sensor detects that that the transmission is not in neutral (i.e. if the shift is in gear), then the remote starter system will disable remote start such that the vehicle cannot be remote started.

Importantly, if the sensor determines that the transmission was moved out of the neutral position after the Reservation Mode was set and subsequently placed back into neutral, the remote starter system will still not allow the vehicle to be remote started even though the transmission is in neutral at the time remote start is attempted.

The remote starter system may detect whether the parking brake is applied by the connection to the vehicle's computer system or other means. If the remote start system determines that the parking brake is not applied, it will not allow a user to remote start the vehicle. Also, a user will be unable to remote start a vehicle if the remote starter system determines that the parking brake was released after the Reservation Mode was set and then reapplied, even if the parking brake is applied at the time the user attempts to remote start the vehicle.

When the user attempts to remote start the vehicle by activating the remote control, the remote control transmits a start-up command to the control module to start the engine if the transmission is in neutral and other safety conditions are met.

For example, the remote starter system will not allow the vehicle to be remote started if any of the following conditions have occurred after the vehicle has been placed in the Reservation Mode: 1) door has been opened; 2) hood has been opened; 3) brake Pedal has been pressed; 4) handbrake has been released; 5) the ignition is on the "On" state; 6) the sensor or accelerometer attached to the gear shifter is not detected; 7) no network connection is detected; 8) remote starter system cannot confirm the status of the vehicle, such as door status, handbrake status, or vehicle signal specification or VSS status; 9) Vehicle's controller area network or CAN is disconnected; 10) memory checksum compare with sensor does not match, such as when memory has been corrupted or reset; 11) battery voltage supervision detects the battery charge is too low or is disconnected; or 12) gear shifter has been moved since the vehicle has been placed in Reservation Mode.

If remote starter turns on the engine and vehicle moves despite the safety measures described above, the remote starter system will shutdown the engine when it detects vehicle movement by reading vehicle signal specification (VSS) value from the vehicle's computer system.

Once the car is successfully started by remote control, the driver can then enter the vehicle, put the key in the ignition, release the parking brake, and operate the vehicle. However, if remote starter system does not detect that the driver has enter the vehicle and taken control of the vehicle properly or as per expected procedure, the system will automatically shut off the engine and the driver will have to start the vehicle normally to place the vehicle into the Reservation Mode to be able to remote start the vehicle.

DETAILED DESCRIPTION OF THE INVENTION

Figure 1:
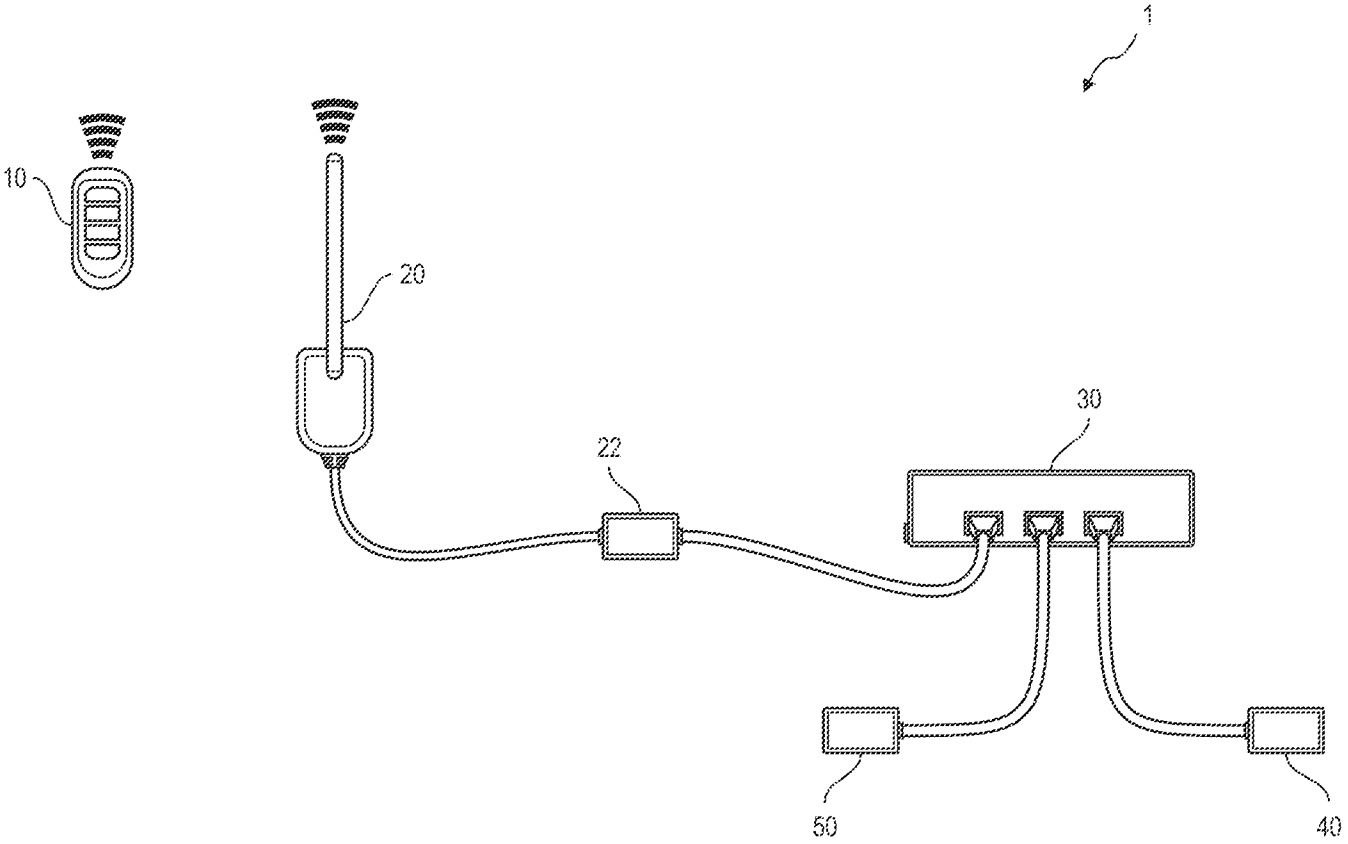
FIG. 1 is a view of the remote starter system.

Referring to FIG. 1, a remote starter system (1) according to the present invention is comprised of a remote control (10), a control module transceiver (20), and a control module (30). The remote starter system's (1) control module (30) further includes a connection to the vehicle's computer system (40) for detecting the status of the vehicle's parameters, and a sensor and accelerometer (50) attached to the gear shifter for detecting the location of the gear shifter.

In an embodiment of the invention, the remote starter system (1), which communicates with a vehicle control system (not shown), has a remote control (10) that is a transceiver for transmitting and receiving a signal. The control module transceiver (20) is also a transceiver capable of receiving and transmitting a signal. The remote starter (30) controls the vehicle control system in accordance with the signal from the remote control (10). More particularly, the remote starter system (1) is adapted to operate in a vehicle with manual transmission, in which the control module (30) receives a signal from the remote control (10) via the control module transceiver (20) and allows the remote start of a vehicle with manual transmission provided that the control module can confirm that the vehicle is in a safe condition to be remote started by analyzing the signals from the vehicle's computer system (4) and the sensor and accelerometer (50). The control module transceiver (20) may be connected to the remote starter (30) through a decoder (22) for decoding the signal from the remote control (10).

Figure 2:
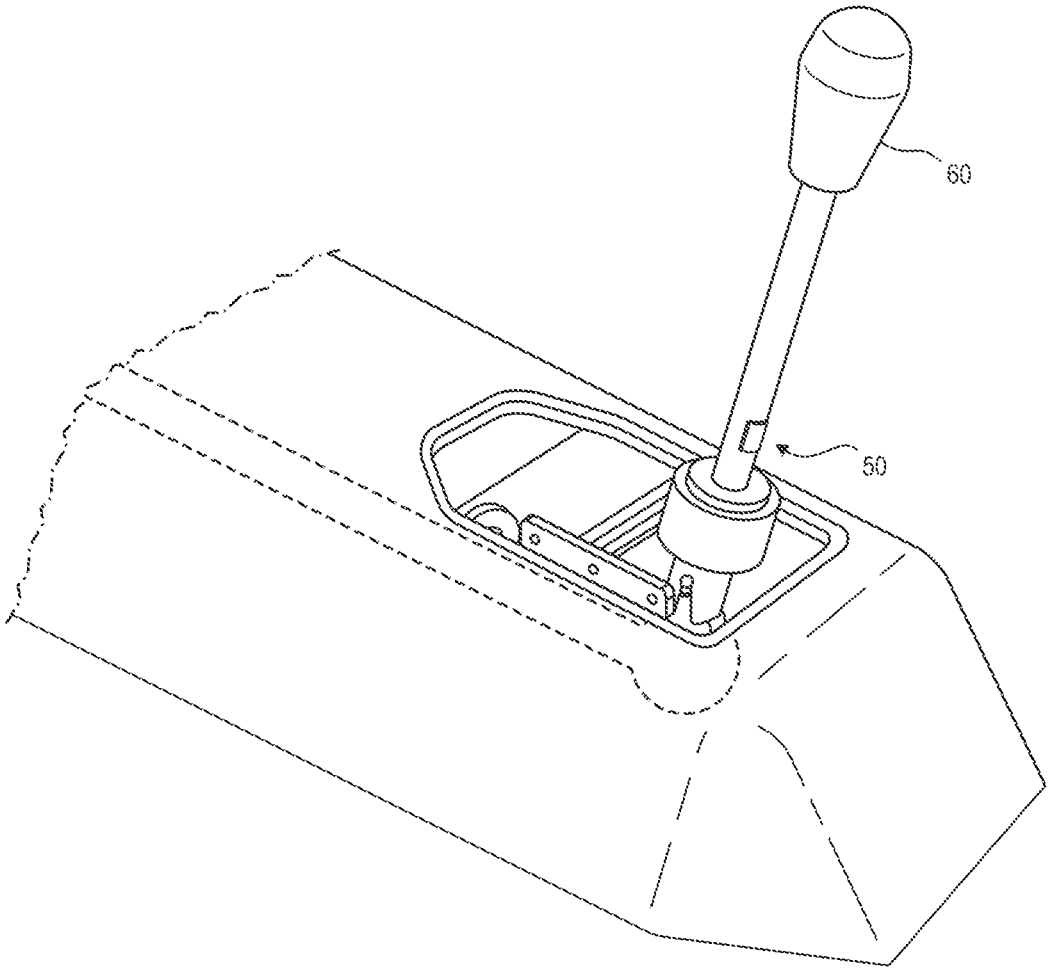
FIG. 2 is a view of the manual transmission gear shifter where the sensor and accelerometer components of the remote starter system would be located.

Referring to FIG. 2, the sensor and accelerometer (50) is affixed to the base of the gear shifter (60). The sensor and accelerometer, along with the lower portion of the gear shifter (60) would be under the gear shifter boot cover (not shown). The sensor and accelerometer (50) can detect the movement of the gear shifter (60) from neutral. The sensor and accelerometer is configured of the movement of gear shifter from neutral, even if the car is not parked on a flat surface, such as when it is parked on an incline while facing uphill or downhill. Thus, the detection of the movement of the gear shifter (60) from neutral is not limited to when the car is only parked on a flat surface.

For vehicles with manual transmission, it is unsafe to remote start a vehicle when the vehicle is left in gear because remote starting the vehicle will likely cause the vehicle to move, posing a risk of property damage and risk of injury to persons. Thus, prior to remote starting a vehicle, a user must place a vehicle with manual transmission in a safe state for remote starting a vehicle, referred herein as Reservation Mode.

Figure 3:
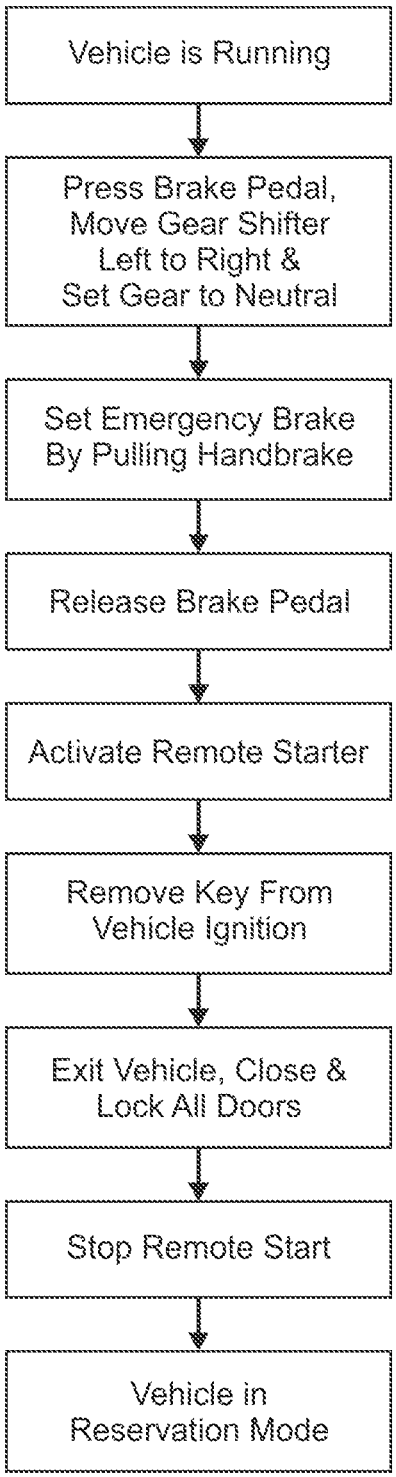
FIG. 3 is a block diagram of a protocol for placing a vehicle with manual transmission into the Reservation Mode to enable remote start of the vehicle.

Referring to FIG. 3, to place the vehicle in Reservation Mode, while the vehicle is running, the user presses the brake pedal. The user then moves the gear shifter (60) left to right and sets the gear to neutral. The user then sets the emergency brake by pulling on the handbrake. After setting the emergency brake, the user releases the brake pedal. The user then activates the remote starter. The user would then remove the key from the vehicle ignition. The engine of the vehicle should still be running even after the removal of the key from the vehicle ignition. The user would exit the vehicle with the engine still running, and close all doors. In one embodiment of the invention, the remote starter system will automatically shutdown the vehicle and lock all doors ten seconds after the last door is closed. In another embodiment of the invention, after exiting the vehicle and closing the doors, the user would use the Remote Control (10) to lock the doors. The Remote starter system will then shutdown the engine. At this point, the vehicle has been placed in Reservation Mode and is safe to be remote started.

Figure 4:
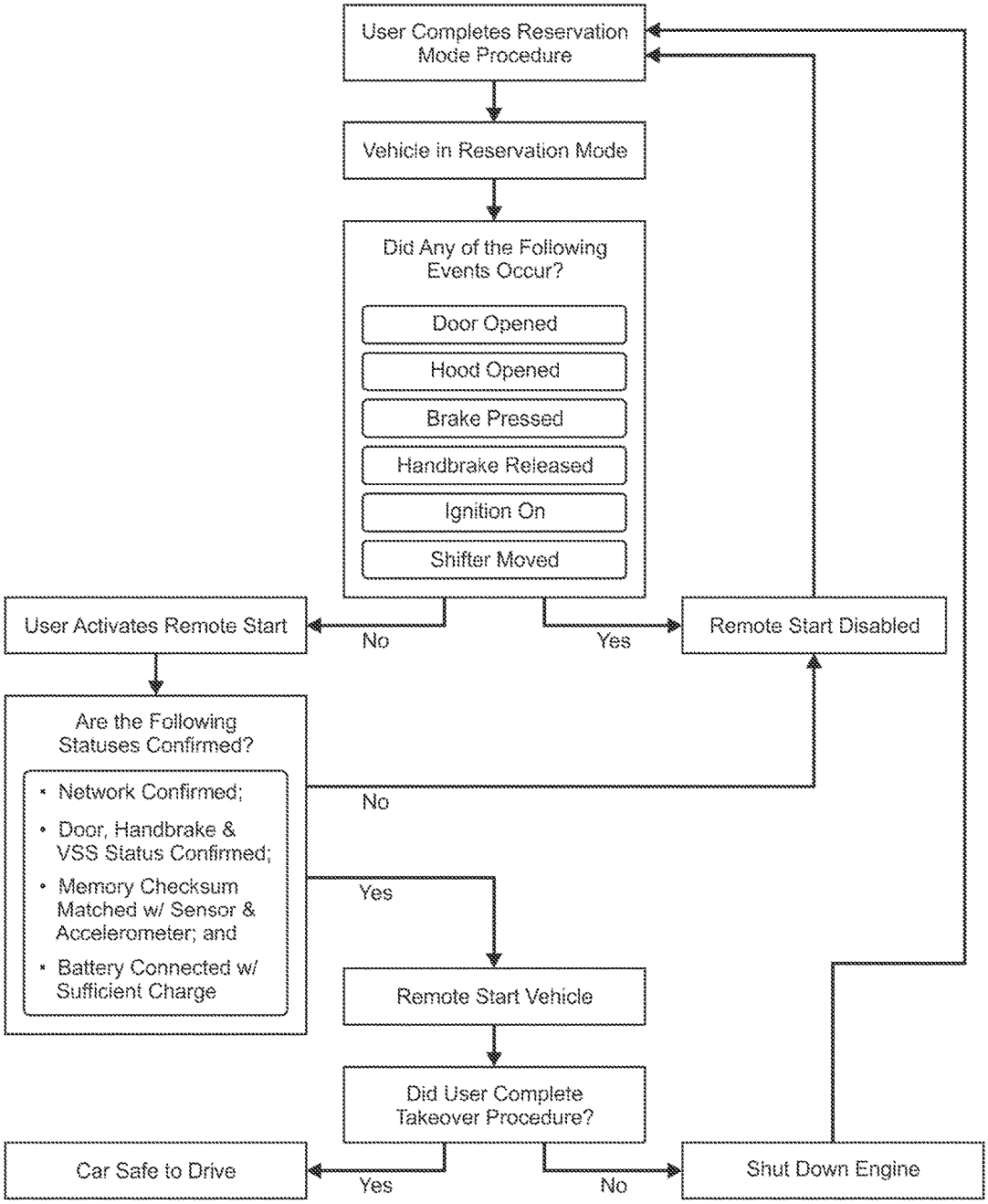
FIG. 4 is a block diagram of a protocol for remote start of the vehicle.

After the vehicle has been placed in Reservation Mode using the procedure in FIG. 3, the vehicle was placed in a condition deemed to be in a safe condition to be remote started. However, referring to FIG. 4, if any of the listed events occur before a user attempts to remote start a vehicle using the Remote Control (10), the user will have to complete the Reservation Mode procedure outlined in FIG. 3 before the user can successfully remote start a vehicle.

For example, if a door of the vehicle is opened after the vehicle has been placed in Reservation Mode, the remote start will be disabled and the user will have to place the vehicle in Reservation Mode using the procedure outlined in FIG. 3 before the vehicle can be remote started. Similarly, if the hood of the vehicle is opened, the brake pedal is pressed, the emergency brake is released using the hand brake, or the shifter has been moved after the vehicle has been placed in Reservation Mode but before the user attempts to remote start the vehicle, remote start will be disabled and the user will have to place the vehicle in Reservation Mode using the procedure if FIG. 3 before the vehicle can be remote started. Likewise, if the vehicle's ignition system has been placed to on, remote start will be disabled and the user will have to follow the steps in FIG. 3 to place the vehicle in Reservation Mode to remote start the vehicle.

Similarly, if the user starts the vehicle normally, the user will have to place the vehicle in Reservation Mode again before the vehicle can be remote started because several of the events would have occurred, such as the door being opened and the ignition being placed to the on setting.

If none of the events occurred, when the user wants to remote start the vehicle after the vehicle has been placed in Reservation Mode, the user will send a signal to the Remote Starter (30) using the Remote Control (10) to remote start the vehicle. The Remote Starter (30) will then confirm the status of the vehicle from the vehicle's computer system (40) and the sensor and accelerometer. The Remote Starter (30) will need to confirm a connection to the vehicle's network to determine that the vehicle is still in a safe condition to remote start the vehicle. Thus, if the Remote Starter (30) does not detect the vehicle network, remote start will be disabled and the user will have to complete the Reservation Mode procedure to be able to remote start the vehicle.

Once the network is confirmed, the Remote Starter (30) will confirm that the door is closed, the handbrake is engaged, and confirm that the vehicle is stationary as confirmed by the Remote Starter receiving information from the VSS through the vehicle's computer. If the Remote Starter cannot confirm those conditions, remote start will be disabled and the user will have to complete the Reservation Mode procedure again to be able to remote start the vehicle.

Even after it confirms the status of the vehicle, the Remote Starter (30) will confirm that the checksum values of the sensor and accelerometer matches the values expected after the vehicle has been placed in Reservation Mode. If the checksum values do not match, the vehicle cannot be remote started. For example, the checksum values may not match if the system was reset, or there is a memory corruption. Even though the other status checks confirm that the vehicle is in a safe condition, remote start will still be disabled when the checksum do not match because the system cannot confirm that vehicle has remained in safe condition to remote start the vehicle for the duration of time since the vehicle has been placed in Reservation Mode.

If the status has been properly confirmed the vehicle will be remote started. Even after the engine is successfully started by the Remote Starter (30), if the reading of the VSS shows that there is vehicle movement, the Remote Starter (30) will shut down the engine, and the user must set the vehicle to Reservation Mode to be able to remote start the vehicle.

After the vehicle has been successfully remote started and no vehicle movement is detected, the user must complete the vehicle takeover procedure within a specified time period. If the user does not complete the vehicle takeover procedure, the remote starter system will shut down the vehicle's engine and the user must complete the Reservation Mode to be able to remote start the vehicle.

Figure 5A:
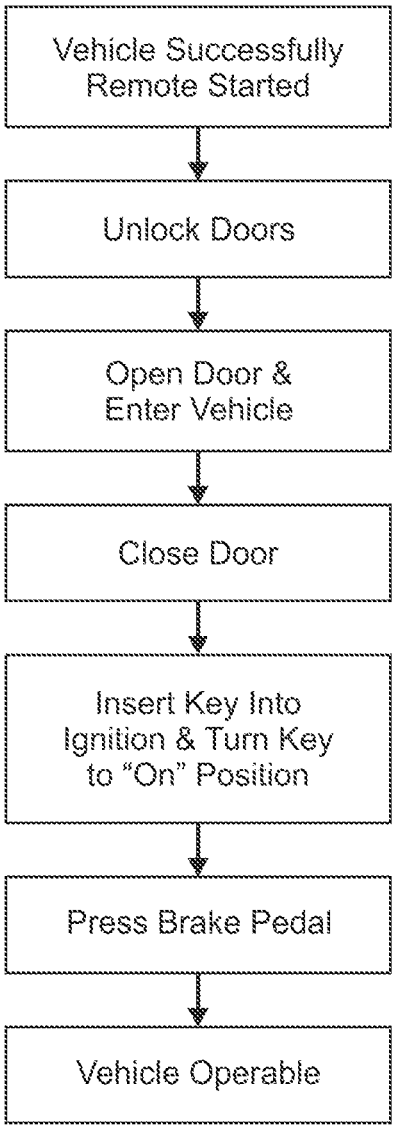
FIG. 5A is a block diagram of a protocol for a user takeover procedure for cars with standard key ignition system.

The vehicle takeover procedure will depend on the type of ignition system on the manual transmission vehicle. Referring to FIG. 5A, for a standard key ignition system, after the vehicle has been successfully remote started, the user must unlock the vehicle doors. The user would open the driver's side door and enter the vehicle. The user would close the door, insert the key into the ignition and turn the key to the "ON" position. The user would press the brake pedal, whereupon the vehicle can be safely operated by the user.

Figure 5B:
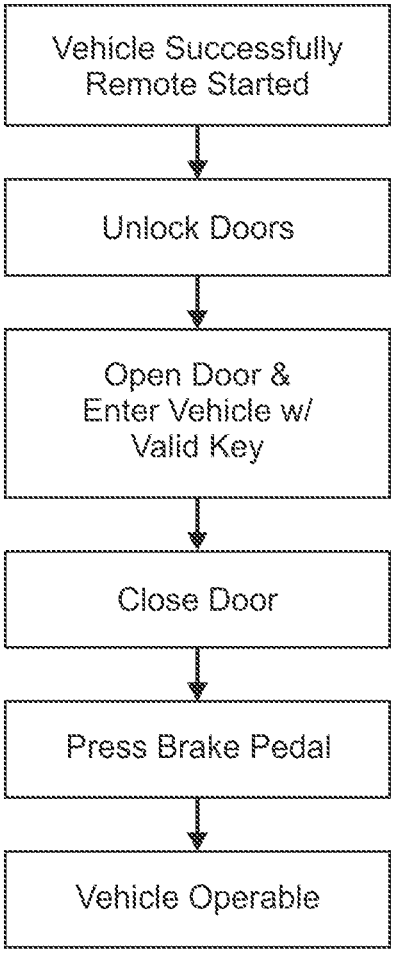
FIG. 5B is a block diagram of a protocol for a user takeover procedure for cars with push to start ignition system.

Referring to FIG. 5B, for the push to start ignition system, to complete the vehicle takeover procedure, the user would unlock and open the driver side door. The user would then enter the vehicle with a valid key and close the door. The user would press the brake pedal, whereupon the vehicle can be safely operated by the user. If the user fails to enter the vehicle with the valid key, the engine will stop because the user has failed to complete the vehicle takeover procedure and the user will then have to repeat the Reservation Mode procedure to be able remote start the vehicle.

I claim:

1. A remote starter system for vehicles with manual transmission comprising:

a remote control transceiver for transmitting and receiving a first signal;

a control module transceiver of receiving and transmitting said first signal;

a sensor and accelerometer attached to a gear shifter of a vehicle with manual transmission and capable to determining the neutral position of said gear shifter;

a control module for controlling a vehicle control system in accordance with said first signal from said remote control transceiver;

said control module connected to a vehicle's computer system to allow said control module to send and receive a second signal relating to the status of the vehicle;

said sensor and accelerometer connected to said control module and capable of transmitting a third signal relating to the position and movement of the gear shifter;

wherein, upon receiving said first signal from said remote control, said control module is capable of remote starting an engine of said vehicle after said vehicle has been placed in a condition safe for remote starting a vehicle with manual transmission prior to the last shutdown of the vehicle ("Reservation Mode") and said control module confirms that said vehicle has remained in said condition safe for remote starting from said second signal from said vehicle computer system and said third signal from said sensor and accelerometer; and said control module continually monitoring said second signal from said vehicle computer system and capable of shutting down said engine of said vehicle upon detecting movement of said vehicle via said second signal from said vehicle computer system; and said control module capable of determining whether a user has taken control of said vehicle after remote start and shutting down said engine of said vehicle after a specified time when said control module fails to detect a user taking control of said vehicle.

2. A remote starter system for vehicles with manual transmission of claim 1 wherein said sensor and accelerometer attached to said gear shifter is capable of learning said neutral position of said gear shifter every time a user places the vehicle in Reservation Mode.

3. A remote starter system for vehicles with manual transmission of claim 1 wherein said sensor and accelerometer attached to said gear shifter is capable of recording and storing information concerning any change in the position of said gear shifter after said vehicle is set in Reservation Mode.

4. A remote starter system for vehicles with manual transmission of claim 1 wherein said control module's detection of a user taking control of said vehicle comprise:

detecting the door being unlocked, opened, and closed by receiving said second signal from the vehicle's computer system;

detecting the key being inserted and turned to the ON position by receiving said second signal from the vehicle's computer system; and detecting the pressing of the brake pedal by receiving said second signal from the vehicle's computer system.

5. A remote starter system for vehicles with manual transmission of claim 1 wherein said control module's detection of a user taking control of said vehicle comprise:

detecting the door being unlocked, opened, and closed by receiving said second signal from the vehicle's computer system;

detecting a valid key in the vehicle by receiving said second signal from the vehicle's computer system; and detecting the pressing of the brake pedal by receiving said second signal from the vehicle's computer system.

6. A remote starter system for vehicles with manual transmission of claim 1 wherein said control module is capable of disabling remote start upon failing to receive said second signal from vehicle's computer system.

7. A remote starter system for vehicles with manual transmission of claim 1 wherein said control module is capable of detecting sufficient charge in said vehicle's battery and disabling remote start when said control module detects insufficient charge.

8. A remote starter system for vehicles with manual transmission of claim 1 wherein said control module is capable of shutting down the engine of said vehicle after remote start upon detecting movement of said vehicle through said second signal from said vehicle's computer system.

* * * * *